US010333220B2

(12) United States Patent
Zhao et al.

(10) Patent No.: US 10,333,220 B2
(45) Date of Patent: Jun. 25, 2019

(54) INTERLEAVED POLARIZED MULTI-BEAM ANTENNA

(71) Applicant: HUAWEI TECHNOLOGIES CO., LTD., Shenzhen, Guangdong (CN)

(72) Inventors: Jianping Zhao, Shanghai (CN); Yang Geng, Shanghai (CN); Qingming Xie, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 57 days.

(21) Appl. No.: 15/636,183

(22) Filed: Jun. 28, 2017

(65) Prior Publication Data

US 2017/0301990 A1 Oct. 19, 2017

Related U.S. Application Data

(63) Continuation of application No. PCT/CN2015/083722, filed on Jul. 10, 2015.

(30) Foreign Application Priority Data

Dec. 30, 2014 (CN) ..... 2014 1 0857222

(51) Int. Cl.
*H01Q 3/26* (2006.01)
*H01Q 3/40* (2006.01)
(Continued)

(52) U.S. Cl.
CPC ..... *H01Q 3/40* (2013.01); *H01Q 21/24* (2013.01); *H01Q 21/296* (2013.01); *H01Q 25/001* (2013.01)

(58) Field of Classification Search
CPC ..... H01Q 3/26–3/40; H01Q 21/24–21/245; H01Q 21/29–21/296; H01Q 25/00–25/001; H01Q 3/00; H01Q 21/00
(Continued)

(56) References Cited

U.S. PATENT DOCUMENTS 5,581,260 A 12/1996 Newman
6,252,560 B1 6/2001 Tanaka et al.
(Continued)

FOREIGN PATENT DOCUMENTS

CN 1376365 A 10/2002
CN 1439184 A 8/2003
(Continued)

OTHER PUBLICATIONS

Extended European Search Report, dated Nov. 15, 2017, in European Application No. 15874820.2 (8 pp.).
(Continued)

*Primary Examiner* — Dameon E Levi
*Assistant Examiner* — Hasan Z Islam
(74) *Attorney, Agent, or Firm* — Staas & Halsey LLP

(57) ABSTRACT

Embodiments of the present invention disclose an interleaved polarized multi-beam antenna, including: at least one dual-polarized antenna element, where the dual-polarized antenna element includes a +45-degree-polarized first antenna element and a −45-degree-polarized second antenna element; and a first Butler matrix and a second Butler matrix, where the first Butler matrix is connected to the first antenna element so that the first antenna element transmits a first target beam, and the second Butler matrix is connected to the second antenna element so that the second antenna element transmits a second target beam. The first target beam and the second target beam in the embodiments are alternately arranged, and any two adjacent first target beam and second target beam have different polarization characteristics; therefore, complexity, a loss, and costs of implementation of a Butler matrix can be effectively reduced, and interference between adjacent multiplexed beams can be effectively decreased.

4 Claims, 6 Drawing Sheets

(51) Int. Cl.

| | |
|---|---|
| ***H01Q 21/24*** | (2006.01) |
| ***H01Q 21/29*** | (2006.01) |
| ***H01Q 25/00*** | (2006.01) |

(58) Field of Classification Search
USPC ..... 343/853, 893; 342/368, 371–373
See application file for complete search history.

(56) References Cited

U.S. PATENT DOCUMENTS

| | | | | |
|---|---|---|---|---|
| 6,577,879 | B1 | 6/2003 | Hagerman et al. | |
| 2004/0160374 | A1 | 8/2004 | Johansson et al. | |
| 2004/0242272 | A1 | 12/2004 | Aiken et al. | |
| 2009/0253387 | A1 | 10/2009 | Van Rensburg et al. | |
| 2009/0322608 | A1* | 12/2009 | Adams | H01Q 1/246 342/368 |
| 2011/0205119 | A1* | 8/2011 | Timofeev | H01Q 1/246 342/373 |
| 2013/0278460 | A1 | 10/2013 | Ai et al. | |
| 2013/0281159 | A1* | 10/2013 | Ai | H01Q 3/26 455/562.1 |

FOREIGN PATENT DOCUMENTS

| | | | |
|---|---|---|---|
| CN | 102834972 | A | 12/2012 |
| CN | 104600437 | A | 5/2015 |
| EP | 1226724 | B1 | 11/2004 |
| JP | 2000-244224 | A | 9/2000 |
| JP | 2013-531434 | A | 8/2013 |
| WO | 01/31944 | A1 | 5/2001 |
| WO | WO03/012924 | | 2/2003 |

OTHER PUBLICATIONS

Korean Office Action dated Mar. 29, 2018 in corresponding Korean Patent Application No. 10-2017-7021117, 6 pgs.
International Search Report dated Sep. 28, 2015 in corresponding International Patent Application No. PCT/CN2015/083722.
Chinese Office Action dated Oct. 14, 2016 in corresponding Chinese Patent Application No. 201410857222.5.
Japanese Office Action dated Aug. 27, 2018 in corresponding Japanese Patent Application No. 2017-534972, 8 pgs.
International Search Report dated Sep. 28, 2015 in corresponding International Application No. PCT/CN2015/083722.

* cited by examiner

INTERLEAVED POLARIZED MULTI-BEAM ANTENNA

CROSS-REFERENCE TO RELATED APPLICATIONS

This application is a continuation of International Application No. PCT/CN2015/083722, filed on Jul. 10, 2015, which claims priority to Chinese Patent Application No. 201410857222.5, filed on Dec. 30, 2014, The disclosures of the aforementioned applications are hereby incorporated by reference in their entireties.

TECHNICAL FIELD

The present invention relates to the field of communications technologies, and in particular, to an interleaved polarized multi-beam antenna.

BACKGROUND

With continuous upgrading of mobile communications systems, new performance requirements are raised for antennas. For example, multi-beam and miniaturization become main factors of modern antenna design. A multi-beam network is a main technology for implementing a multi-beam antenna by utilizing space selectivity. A method in which the space selectivity is utilized can bring benefits in two aspects: first, selective transmission and receiving are performed, so that interference to a neighboring cell and interference from the neighboring cell can be reduced, second, spatial multiplexing is formed among multiple beams.

A multi-beam antenna system includes two parts: one part is a dual-polarized array formed by dual-polarized antenna units, and the other part is a Butler (Butler) matrix, and the dual-polarized array is connected to the Butler matrix. The Butler matrix is a completely passive and reciprocal circuit, and the circuit includes several directional couplers and phase shift elements. The Butler matrix is configured to generate a beam, and the beam generated by the Butler matrix is transmitted by using the dual-polarized array. Currently, in a multi-beam antenna system application, same beams are used in two polarization directions to form a network; therefore, two polarizations exist in each beam direction (see FIG. 1). The foregoing multi-beam antenna system becomes a cross-polarization multi-beam antenna system. Effects of such a cross-polarization multi-beam antenna system are polarization diversity or multiplexing inside a beam and multiplexing among beams.

FIG. 1 shows multiple beams that are formed by a four-column dual-polarized antenna, where each polarization uses an amplitude and a phase in Table 1, and two polarizations both point to a same direction.

TABLE 1

| | Column 1 | Column 2 | Column 3 | Column 4 |
|---|---|---|---|---|
| Beam 1 | $1\angle -225$ | $1\angle -180$ | $1\angle -135$ | $1\angle -90$ |
| Beam 2 | $1\angle 45$ | $1\angle -90$ | $1\angle -225$ | $1\angle 0$ |
| Beam 3 | $1\angle -270$ | $1\angle -135$ | $1\angle 0$ | $1\angle 135$ |
| Beam 4 | $1\angle 0$ | $1\angle -45$ | $1\angle -90$ | $1\angle -135$ |

The cross-polarization multi-beam system is an orthogonal system, that is, each direction in which a maximum value is reached of a beam of each polarization is basically a null or a sidelobe of another beam of the same polarization. Main problems of the cross-polarization multi-beam system lie in: first, generally, when a relatively large quantity of multiple beams are formed in such a system, a quantity of stages of a multi-beam matrix increases, for example, a three-stage network needs to be used when six beams are to be formed, and when a quantity of network stages of increases, a machining difficulty and a network loss significantly increase; second, a sidelobe is difficult to be reduced, and sidelobe levels of two most-lateral beams are higher for a Butler-type matrix in general, and therefore interference between adjacent multiplexed beams increases.

SUMMARY

Embodiments of the present invention provide an interleaved polarized multi-beam antenna.

A first aspect of the embodiments of the present invention provides an interleaved polarized multi-beam antenna, including:

at least one dual-polarized antenna element, where the dual-polarized antenna element includes a +45-degree-polarized first antenna element and a −45-degree-polarized second antenna element; and a first Butler matrix and a second Butler matrix, where the first Butler matrix is connected to the first antenna element so that the first antenna element transmits a first target beam, the first target beam is generated by the first Butler matrix according to a first input signal received by at least one first beam port, and each first target beam points to a different direction; and the second Butler matrix is connected to the second antenna element so that the second antenna element transmits a second target beam, the second target beam is generated by the second Butler matrix according to a second input signal received by at least one second beam port, and each second target beam points to a different direction, where one second target beam is arranged between any two adjacent first target beams.

With reference to the first aspect of the embodiments of the present invention, in a first implementation manner of the first aspect of the embodiments of the present invention, the interleaved polarized multi-beam antenna includes six dual-polarized antenna elements, first target beams are generated by the first Butler matrix according to first input signals received by three first beam ports, and second target beams are generated by the second Butler matrix according to second input signals received by two second beam ports.

With reference to the first implementation manner of the first aspect of the embodiments of the present invention, in a second implementation manner of the first aspect of the embodiments of the present invention, the first Butler matrix includes:

a first group of bridges, a second group of bridges, and a first group of power splitters, where the first group of bridges are connected to three first beam ports to receive three first input signals, and the first group of bridges generate four signals in total according to the three first input signals and output the four signals; and the second group of bridges are connected to the first group of bridges to receive the four signals output by the first group of bridges, the second group of bridges generate four signals in total according to the four signals output by the first group of bridges and output the four signals, the second group of bridges output two signals generated by the second group of bridges to the first group of power splitters connected to the second group of bridges, and the second group of bridges output the other two signals generated by the second group of bridges to first antenna elements of two of the dual-polarized antenna elements; and the first group of power splitters are configured to: split each of the two signals input from the second group of bridges into two signals, and output the formed four signals to first antenna elements of four of the dual-polarized antenna elements, so that six first antenna elements transmit the first target beams.

With reference to the second implementation manner of the first aspect of the embodiments of the present invention, in a third implementation manner of the first aspect of the embodiments of the present invention, the first group of bridges include a first bridge and a second bridge, the first bridge is a three-decibel 90-degree bridge, and the second bridge is a three-decibel 180-degree bridge;

the second group of bridges include a third bridge and a fourth bridge, and the third bridge and the fourth bridge are both a three-decibel 180-degree bridge; and the first group of power splitters include a first power splitter and a second power splitter, and a ratio of divided power output by the first power splitter and the second power splitter is 3:7.

With reference to the first implementation manner of the first aspect of the embodiments of the present invention, in a fourth implementation manner of the first aspect of the embodiments of the present invention, the second Butler matrix includes:

a third group of bridges, a fourth group of bridges, a first group of phase shifters, a second group of power splitters, and a second group of phase shifters, where the third group of bridges are connected to two second beam ports to receive two second input signals, the third group of bridges generate four signals in total according to the two second input signals and output the four signals, the third group of bridges output two signals generated by the third group of bridges to the first group of phase shifters connected to the third group of bridges, and the third group of bridges output the other two signals generated by the third group of bridges to the fourth group of bridges connected to the third group of bridges;

the fourth group of bridges are connected to the first group of phase shifters, the fourth group of bridges receive two signals that are output by the first group of phase shifters after performing phase shift and the two signals output by the third group of bridges to generate four signals and output the four signals, the fourth group of bridges output two signals output by the fourth group of bridges to second antenna elements of two of the dual-polarized antenna elements, and the fourth group of bridges output the other two signals output by the fourth group of bridges to the second group of power splitters connected to the fourth group of bridges; and the second group of power splitters are configured to split each of the two signals that are input from the fourth group of bridges into two signals to form four signals in total and output the four signals, the second group of power splitters output two signals output by the second group of power splitters to the second group of phase shifters connected to the second group of power splitters, the second group of phase shifters output two phase-shifted signals to second antenna elements of two of the dual-polarized antenna elements, and the second group of power splitters output the other two signals output by the second group of power splitters to second antenna elements of two of the dual-polarized antenna elements, so that six second antenna elements transmit the second target beams.

With reference to the fourth implementation manner of the first aspect of the embodiments of the present invention, in a fifth implementation manner of the first aspect of the embodiments of the present invention, the third group of bridges include a fifth bridge and a sixth bridge, and the fifth bridge and the sixth bridge are both a three-decibel 90-degree bridge;

the fourth group of bridges include a seventh bridge and an eighth bridge, and the seventh bridge and the eighth bridge are both a three-decibel 90-degree bridge;

the first group of phase shifters include a first phase shifter and a second phase shifter, and phases shifted by the first phase shifter and the second phase shifter are both −45 degrees;

the second group of power splitters include a third power splitter and a fourth power splitter, and a divided power output by the third power splitter and the fourth power splitter is 3:7; and the second group of phase shifters include a third phase shifter and a fourth phase shifter, and phases shifted by the third phase shifter and the fourth phase shifter are both −180 degrees.

The embodiments of the present invention provide an interleaved polarized multi-beam antenna, including: at least one dual-polarized antenna element, where the dual-polarized antenna element includes a +45-degree-polarized first antenna element and a −45-degree-polarized second antenna element; and a first Butler matrix and a second Butler matrix, where the first Butler matrix is connected to the first antenna element to generate a first target beam, and the second Butler matrix is connected to the second antenna element to generate a second target beam. In the embodiments, the first target beam and the second target beam are alternately arranged, any two adjacent first target beam and second target beam have different polarization characteristics, each first target beam points to a different direction, and each second target beam points to a different direction. Therefore, complexity, a loss, and costs of implementation of a Butler matrix can be effectively reduced, interference between adjacent multiplexed beams can be effectively decreased, and a network loss can be effectively reduced.

DESCRIPTION OF EMBODIMENTS

Embodiments of the present invention provide an interleaved polarized multi-beam antenna. The interleaved polarized multi-beam antenna can effectively improve technical problems of a great implementation difficulty, a large insertion loss, poor sidelobe quality, and great interference between adjacent beams that exist in a feeding network of a cross-polarization multi-beam system in the prior art.

A specific structure of an interleaved polarized multi-beam antenna in an embodiment is described in detail below with reference to FIG. 2.

The interleaved polarized multi-beam antenna includes:

an antenna array 201, where the antenna array 201 includes at least one dual-polarized antenna element.

The dual-polarized antenna element includes a +45-degree-polarized first antenna element 2011 and a −45-degree-polarized second antenna element 2012.

Figure 1:
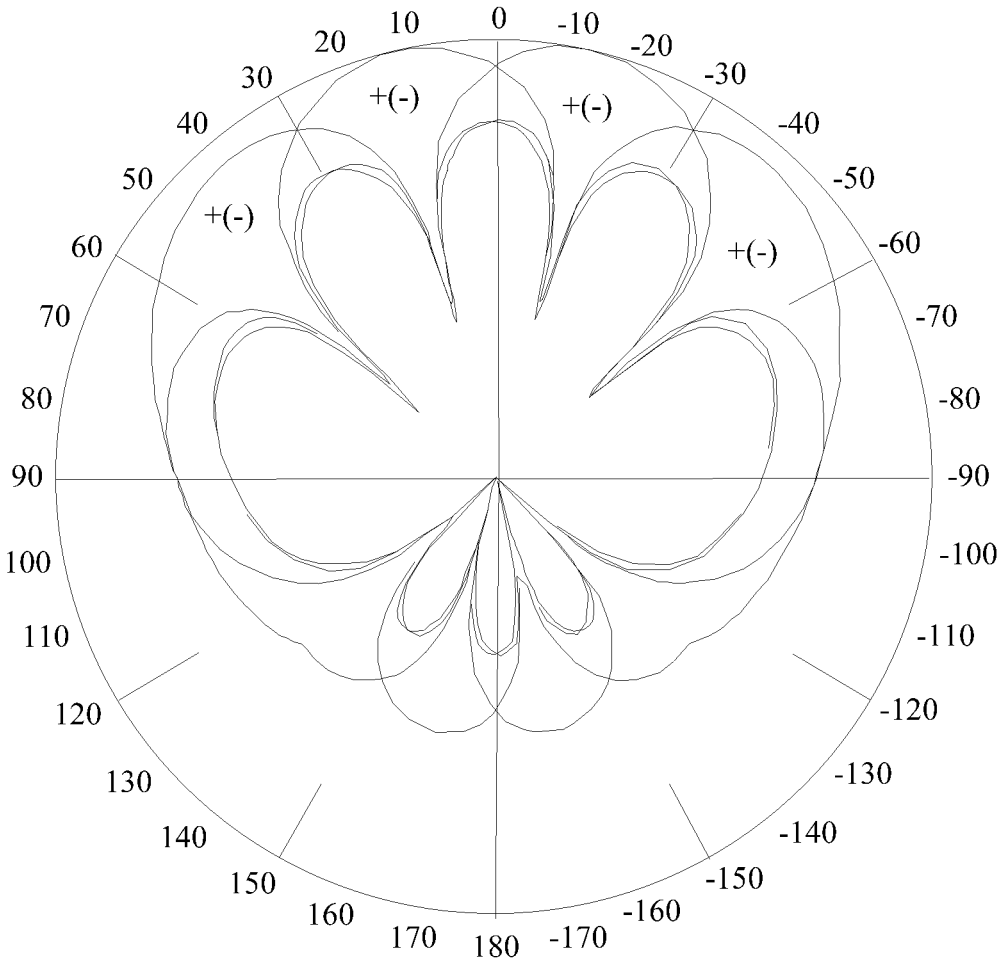
FIG. 1 (Prior Art)
FIG. 1 is a schematic diagram of four beams that are formed by a four-column dual-polarized antenna in the prior art.
Figure 2:
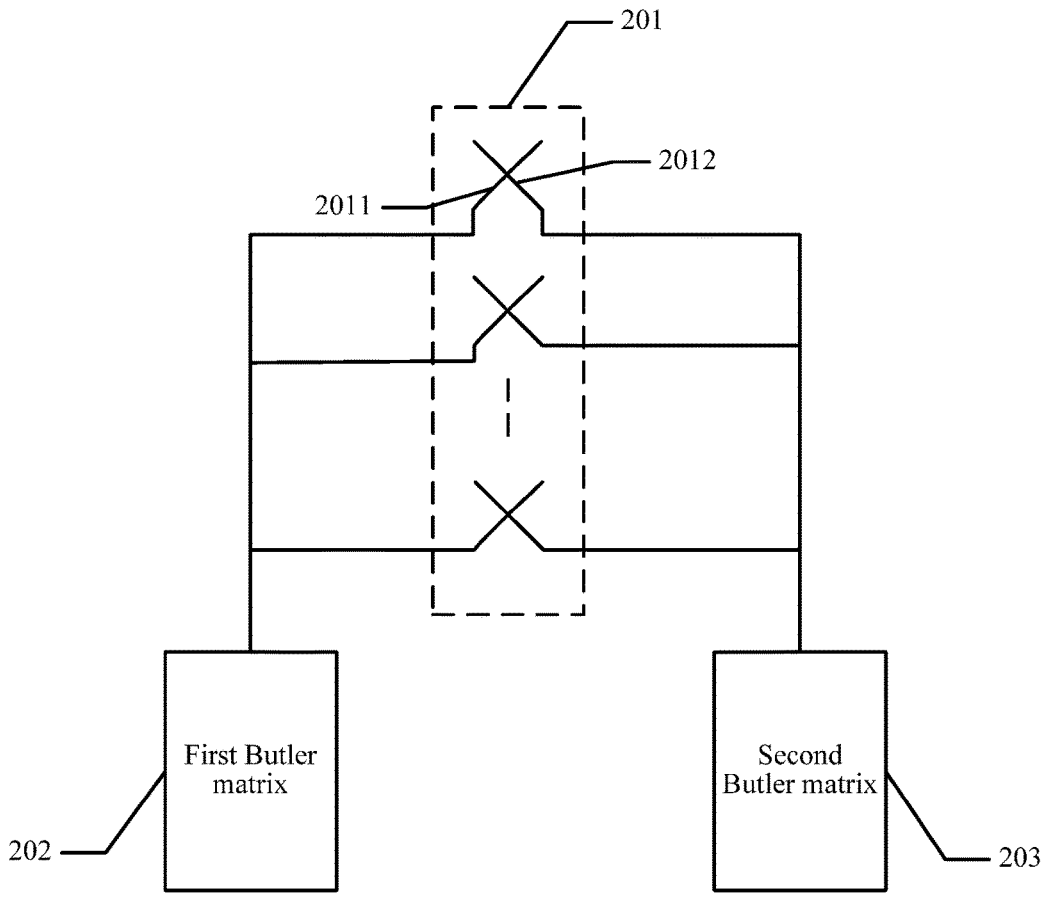
FIG. 2 is a schematic structural diagram of an embodiment of an interleaved polarized multi-beam antenna according to an embodiment of the present invention.

The first antenna element 2011 and the second antenna element 2012 in this embodiment are orthogonally ±45-degree arranged, and configured to form mutually-orthogonal linearly-polarized electromagnetic waves in space, and antenna elements of each column of linearly dual-polarized antennas are linearly arranged, as shown in FIG. 2. For a specific structure and an implementation principle of the dual-polarized antenna element, refer to the prior art, and details are not described in this embodiment.

A quantity of dual-polarized antenna elements included in the antenna array 201 in this embodiment is n, where n is a positive integer, that is, a specific quantity of the dual-polarized antenna element is not limited in this embodiment.

The interleaved polarized multi-beam antenna further includes a first Butler matrix 202 and a second Butler matrix 203.

The first Butler matrix 202 is connected to the first antenna element 2011, so that the first antenna element 2011 transmits a first target beam.

Specifically, the first target beam is generated by the first Butler matrix 202 according to a first input signal received by at least one first beam port, so that the first target beam is transmitted by using the first antenna element 2011 connected to the first Butler matrix 202.

Specifically, the second target beam is generated by the second Butler matrix 203 according to a second input signal received by at least one second beam port, so that the second target beam is transmitted by using the second antenna element 2012 connected to the second Butler matrix 203.

More specifically, one second target beam is arranged between any two adjacent first target beams, that is, the any two adjacent first target beams and the second target beam have different polarization characteristics.

It should be noted that, components specifically included in the first Butler matrix 202 and the second Butler matrix 203 and specific structures of the first Butler matrix 202 and the second Butler matrix 203 are not limited in this embodiment, provided that the first Butler matrix 202 generates the first target beam and the second Butler matrix 203 generates the second target beam.

In this embodiment, the first Butler matrix 202 is connected to only the +45-degree-polarized first antenna element 2011, so that the first target beam generated by the first Butler matrix 202 has only a unique positive-polarization characteristic in each beam direction. The second Butler matrix 203 is connected to only the −45-degree-polarized second antenna element 2012, so that the second target beam generated by the second Butler matrix 203 has only a unique negative-polarization characteristic in each beam direction. Moreover, each first target beam and each second target beam are alternately arranged, that is, any two adjacent beams have different polarization characteristics, and beams have different directions.

The first target beam and the second target beam in this embodiment are alternately arranged; therefore, the interleaved polarized multi-beam antenna in this embodiment can effectively reduce complexity, a loss, and costs of implementation of a Butler matrix, and effectively decrease interference between adjacent multiplexed beams.

Specific quantities of the first target beams and the second target beams are not limited in this embodiment, provided that any two adjacent beams have different polarization characteristics, and beams have different directions.

In this embodiment, specific arrangement manners of the first Butler matrix 202 and the second Butler matrix 203 are not limited, provided that the first Butler matrix 202 and the second Butler matrix 203 are both connected to the antenna array 201. Beams covering a target area are generated by using the two Butler matrixes, so as to reduce a quantity of network stages of a Butler matrix by one, thereby greatly reducing a machining difficulty and reducing a network loss.

The first Butler matrix 202 and the second Butler matrix 203 in this embodiment may be arranged in parallel or correspondingly vertically arranged. Preferably, an example in which the first Butler matrix 202 and the second Butler matrix 203 are vertically arranged is used in this embodiment, so as to bring a beneficial effect that an area occupied by the antenna can be reduced by vertically arranging the two Butler matrixes, thereby facilitating assembly and maintenance.

A specific structure of the first Butler matrix 202 is described in detail below with reference to FIG. 3.

Figure 3:
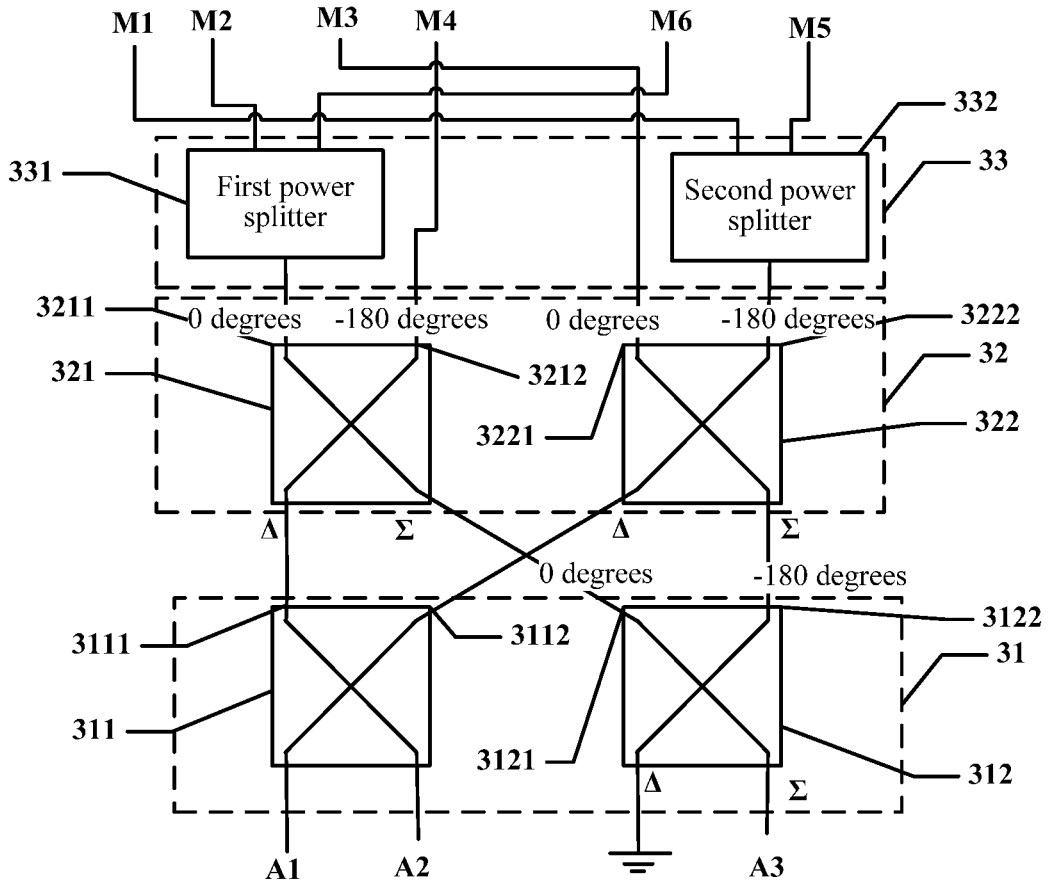
FIG. 3 is a schematic structural diagram of an embodiment of a first Butler matrix of an interleaved polarized multi-beam antenna according to an embodiment of the present invention.

It should be noted that, the structure of the first Butler matrix 202 shown in FIG. 3 is merely an example, rather than a limitation to a specific structure of the first Butler matrix 202, provided that the first Butler matrix 202 can generate a first target beam satisfying the foregoing conditions.

The interleaved polarized multi-beam antenna shown in FIG. 3 is described by using an example in which the quantity of the dual-polarized antenna elements is six. It should be noted that, the quantity of the dual-polarized antenna elements in this embodiment is an example fbr description rather than a limitation.

Specifically, six dual-polarized antenna elements include +45-degree-polarized first antenna elements (M1, M2, M3, M4, M5, and M6) and −45-degree-polarized second antenna elements (N1, N2, N3, N4, N5, and N6). That is, the first antenna element M1 and the second antenna element N1 are orthogonally ±45-degree arranged, and so on, and the first antenna element M6 and the second antenna element N6 are orthogonally ±45-degree arranged.

The first Butler matrix in this embodiment includes:

a first group of bridges 31, a second group of bridges 32, and a first group of power splitters 33.

One end of the first group of bridges 31 is connected to first beam ports.

The first group of bridges 31 are connected to three first beam ports to receive three first input signals, and the first group of bridges 31 generate four signals in total according to the three first input signals and output the four signals.

The second group of bridges 32 are connected to the first group of bridges 31 to receive the four signals output by the first group of bridges 31, the second group of bridges 32 generate four signals in total according to the four signals output by the first group of bridges 31 and output the four signals, the second group of bridges 32 output two signals generated by the second group of bridges 32 to the first group of power splitters 33 connected to the second group of bridges 32, and the second group of bridges 32 output the other two signals generated by the second group of bridges 32 to first antenna elements (M4 and M3) of two of the dual-polarized antenna elements.

The first group of power splitters 33 are configured to: split each of the two signals input from the second group of bridges 32 into two signals, and output the formed four signals to first antenna elements (M2, M6, M1, and M5) of four of the dual-polarized antenna elements, so that the six first antenna elements (M1, M2, M3, M4, M5, and M6) transmit the first target beams.

A specific internal structure of the first Butler matrix is described in detail below.

There are three first beam ports (that is, A1, A2, and A3) for receiving first input signals, as shown in FIG. 3.

The first group of bridges 31 of the first Butler matrix specifically include a first bridge 311 and a second bridge 312, the first bridge 311 is a three-decibel 90-degree bridge, and the second bridge 312 is a three-decibel 180-degree bridge. The second group of bridges 32 include a third bridge 321 and a fourth bridge 322, and the third bridge 321 and the fourth bridge 322 are both a three-decibel 180-degree bridge.

Figure 4:
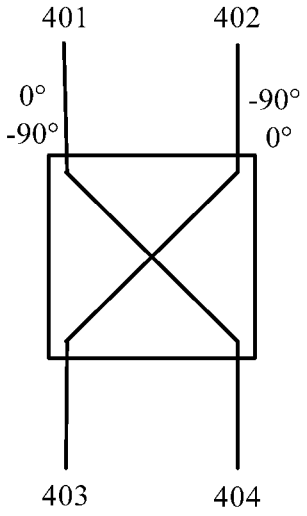
FIG. 4 is a schematic structural diagram of a bridge principle of a three-decibel 90-degree bridge according to an embodiment of the present invention.

A bridge principle of the three-decibel 90-degree bridge is described in detail below with reference to FIG. 4.

The three-decibel 90-degree bridge is formed by a power hybrid network with four ports, where two output ports 401 and 402 have a characteristic of outputting signals with a phase difference of 90 degrees, and phases of a direct port and a coupled port differ by −90°.

That is, when a signal is input from 403, phases of a direct port (401) and a coupled port (402) are respectively −180° and −90°, and a ratio of power of the two ports is 1:1. When a signal is input from 404, phases of a direct port (402) and a coupled port (401) are respectively −90° and −180°, and a ratio of power of the two ports is 1:1.

Figure 5:
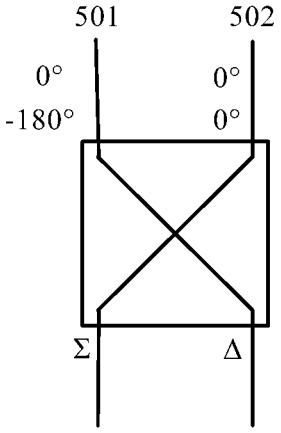
FIG. 5 is a schematic structural diagram of a bridge principle of a three-decibel 180-degree bridge according to an embodiment of the present invention.

A bridge principle of the three-decibel 180-degree bridge is described in detail below with reference to FIG. 5.

Σ and Δ of the three-decibel 180-degree bridge respectively represent a sum port and a difference port of the 180-degree bridge. For the 3 dB 180° bridge, when a signal is input from the sum port (Σ), phases of a direct port and a coupled port are generally both −90°, a difference between phase shifts of the two output ports is 0°, and a ratio of power of the output port 501 and the output port 502 is 1:1; when a signal is input from the difference port (Δ), phases of a direct port and a coupled port are respectively −270° and −90°, and a difference between phase shifts of the two output ports is −180°, and a ratio of power of the output port 501 and the output port 502 is 1:1.

For bridge principles of a three-decibel 90-degree bridge and a three-decibel 180-degree bridge below, refer to FIG. 4 and FIG. 5, and details are not described again.

Further referring to FIG. 3, the first bridge 311 that is a three-decibel 90-degree bridge receives first input signals from the first beam port A1 and the first beam port A2, a sum port of the second bridge 312 that is a three-decibel 180-degree bridge is the first beam port A3 configured to receive the first input signal, and a difference port of the second bridge 312 is grounded.

An output port 3111 of the first bridge 311 is connected to a difference port of the third bridge 321 in the second group of bridges 32, and an output port 3112 of the first bridge 311 is connected to a difference port of the fourth bridge 322 of the second group of bridges 32.

An output port 3121 of the second bridge 312 is connected to a sum port of the third bridge 321 in the second group of bridges 32, and an output port 3122 of the second bridge 312 is connected to a sum port of the fourth bridge 322 in the second group of bridges 32.

An output port 3211 of the third bridge 321 is connected to a first power splitter 331 in the first group of power splitters 33, and an output port 3212 of the third bridge 321 is connected to the first antenna element M4.

An output port 3221 of the fourth bridge 322 is connected to the first antenna element M3, and an output port 3222 of the fourth bridge 322 is connected to a second power splitter 332 in the first group of power splitters 33.

Specifically, a ratio of divided power output by the first power splitter 331 and the second power splitter 332 is 3:7.

The ratio of divided power output by the power splitters in this embodiment is used as an example for description, rather than a limitation.

The first power splitter 331 is configured to: split the signal input by the third bridge 321 into two signals, where a ratio of divided power of the output signals is 3:7, and respectively output the two output signals to the first antenna elements M2 and M6.

The second power splitter 332 is configured to: split the signal input by the fourth bridge 322 into two signals, where a ratio of divided power of the output signals is 3:7, and respectively output the two output signals to the first antenna elements M5 and M1, so that the first antenna elements M1, M2, M3, M4, M5, and M6 transmit the first target beams.

Specifically, amplitudes and phases of the polarized beams of the first Butler matrix are shown in Table 2.

TABLE 2

| | M1 | M2 | M3 | M4 | M5 | M6 |
|---|---|---|---|---|---|---|
| A1 | 0.54∠90 | 0.84∠0 | 1∠−90 | 1∠−180 | 0.84∠90 | 0.54∠0 |
| A2 | 0.54∠180 | 0.84∠−90 | 1∠0 | 1∠90 | 0.84∠180 | 0.54∠−90 |
| A3 | 0.54∠0 | 0.84∠0 | 1∠0 | 1∠0 | 0.84∠0 | 0.54∠0 |

A specific structure of the second Butler matrix is described in detail below with reference to FIG. 6.

The second Butler matrix specifically includes:

a third group of bridges 61, a fourth group of bridges 63, a first group of phase shifters 62, a second group of phase shifters, and a second group of power splitters 64.

The third group of bridges 61 are connected to the two second beam ports to receive the two second input signals, and the second beam ports are connected to the second antenna elements.

The third group of bridges 61 generate four signals in total according to the two second input signals and output the four signals, the third group of bridges output two signals generated by the third group of bridges to the first group of phase shifters 62 connected to the third group of bridges, and the third group of bridges 61 output the other two signals generated by the third group of bridges 61 to the fourth group of bridges 63 connected to the third group of bridges 61.

The fourth group of bridges 63 are connected to the first group of phase shifters 62, the fourth group of bridges 63 receive two signals that are output by the first group of phase shifters 62 after performing phase shift and the two signals output by the third group of bridges 61 to generate four signals and output the four signals, the fourth group of bridges 63 output two signals output by the fourth group of bridges 63 to second antenna elements (N4 and N3) of two of the dual-polarized antenna elements, and the fourth group of bridges 63 output the other two signals output by the fourth group of bridges 63 to the second group of power splitters 64 connected to the fourth group of bridges 63.

The second group of power splitters 64 are configured to split each of the two signals that are input from the fourth group of bridges 63 into two signals to form four signals in total and output the four signals, and the second group of power splitters 64 output two signals output by the second group of power splitters 64 to the second group of phase shifters connected to the second group of power splitters 64.

The second group of phase shifters output two phase-shifted signals to second antenna elements (N1 and N6) of two of the dual-polarized antenna elements, and the second group of power splitters 64 output the other two signals output by the second group of power splitters 64 to second antenna elements (N2 and N5) of two of the dual-polarized antenna elements, so that the six second antenna elements transmit the second target beams.

A specific internal structure of the second Butler matrix is described in detail below.

Figure 6:
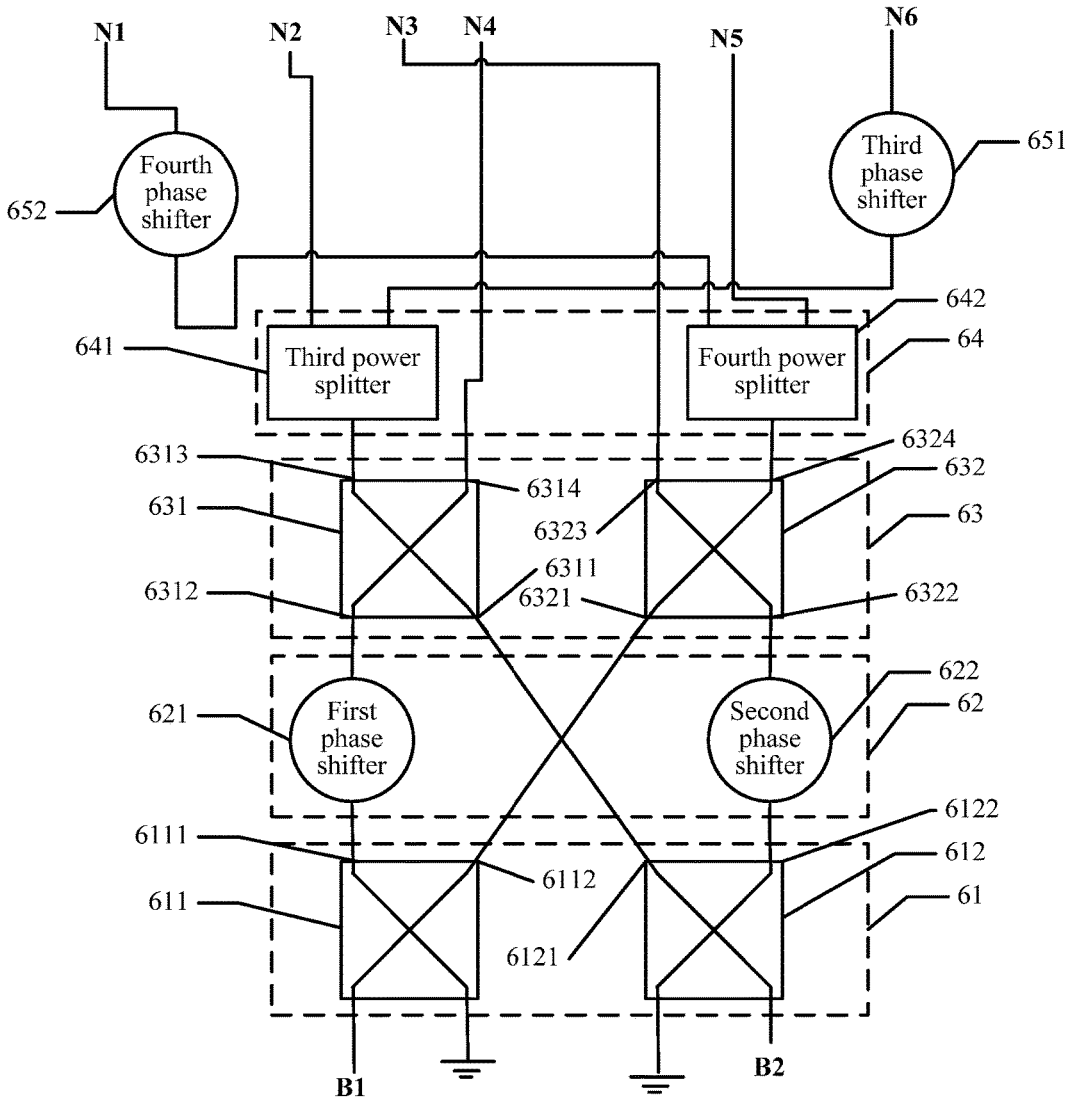
FIG. 6 is a schematic structural diagram of an embodiment of a second Butler matrix of an interleaved polarized multi-beam antenna according to an embodiment of the present invention.

There are two second beam ports (that is, B1 and B2) for receiving second input signals, as shown in FIG. 6.

The third group of bridges 61 of the second Butler matrix include a fifth bridge 611 and a sixth bridge 612, and the fifth bridge 611 and the sixth bridge 612 are both a three-decibel 90-degree bridge.

The fourth group of bridges 63 include a seventh bridge 631 and an eighth bridge 632, and the seventh bridge 631 and the eighth bridge 632 are both a three-decibel 90-degree bridge.

Specifically, the input port B1 of the fifth bridge 611 is the second beam port, that is, the fifth bridge 611 receives the second input signal by means of the second beam port B1, and the other input port of the fifth bridge 611 is grounded.

The input port B2 of the sixth bridge 612 is the second beam port, that is, the sixth bridge 612 receives the second input signal by means of the second beam port B2, and the other input port of the sixth bridge 612 is grounded.

An output port 6111 of the fifth bridge 611 is connected to a first phase shifter 621 of the first group of phase shifters 62, that is, the first phase shifter 621 receives a signal input from the output port 6111 of the fifth bridge 611, and performs phase shift.

In this embodiment, a phase shifted by the first phase shifter 621 is −45 degrees.

It should be noted that, that the phase shifted by the first phase shifter 621 is −45 degrees in this embodiment is used as an example for description, rather than a limitation.

An output port 6112 of the fifth bridge 611 is connected to an input port 6321 of the eighth bridge 632 of the fourth group of bridges 63.

An output port 6121 of the sixth bridge 612 is connected to an input port 6311 of the seventh bridge 631 of the fourth group of bridges 63.

An output port 6122 of the sixth bridge 612 is connected to a second phase shifter 622 of the first group of phase shifters 62, that is, the second phase shifter 622 receives a signal input from the output port 6122 of the sixth bridge 612, and performs phase shift.

In this embodiment, a phase shifted by the second phase shifter 622 is −45 degrees.

It should be noted that, that the phase shifted by the second phase shifter 622 is −45 degrees in this embodiment is used as an example for description, rather than a limitation.

An output port of the first phase shifter 621 is connected to an input port 6312 of the seventh bridge 631.

An output port of the second phase shifter 622 is connected to an input port 6322 of the eighth bridge 632.

An output port 6313 of the seventh bridge 631 is connected to an input port of a third power splitter 641 in the second group of power splitters 64, and an output port 6314 of the seventh bridge 631 is connected to the second antenna element N4.

An output port 6323 of the eighth bridge 632 is connected to the second antenna element N3, and an output port 6324 of the eighth bridge 632 is connected to an input port of a fourth power splitter 642 in the second group of power splitters 64.

The third power splitter 641 is configured to: split a signal that is received by means of the input port of the third power splitter 641 and that is input from the output port 6313 of the seventh bridge 631 into two signals, output one signal to the second antenna element N2, and output the other signal to a third phase shifter 651 in the second group of phase shifters.

The fourth power splitter 642 is configured to: split a signal that is received by means of the input port of the fourth power splitter 642 and that is input from the output port 6324 of the eighth bridge 632 into two signals, output one signal to the second antenna element N5, and output the other signal to a fourth phase shifter 652 in the second group of phase shifters.

Specifically, a ratio of divided power output by the third power splitter 641 and the fourth power splitter 642 in the second group of power splitters 64 is 3:7.

Phases shifted by the third phase shifter 651 and the fourth phase shifter 652 in the second group of phase shifters are both −180 degrees.

The fourth phase shifter 652 outputs a phase-shifted signal to the second antenna element N1, and the third phase shifter 651 outputs a phase-shifted signal to the second antenna element N6, so that the second antenna elements N1, N2, N3, N4, N5, and N6 transmit the second target beams.

Specifically, amplitudes and phases of the polarized beams of the second Butler matrix are shown in Table. 3.

TABLE 3

| | N1 | N2 | N3 | N4 | N5 | N6 |
|---|---|---|---|---|---|---|
| B1 | $0.54\angle 0$ | $0.84\angle -45$ | $1\angle -90$ | $1\angle -135$ | $0.84\angle -180$ | $0.54\angle -225$ |
| B2 | $0.54\angle -225$ | $0.84\angle -180$ | $1\angle -135$ | $1\angle -90$ | $0.84\angle -45$ | $0.54\angle 0$ |

Figure 7:
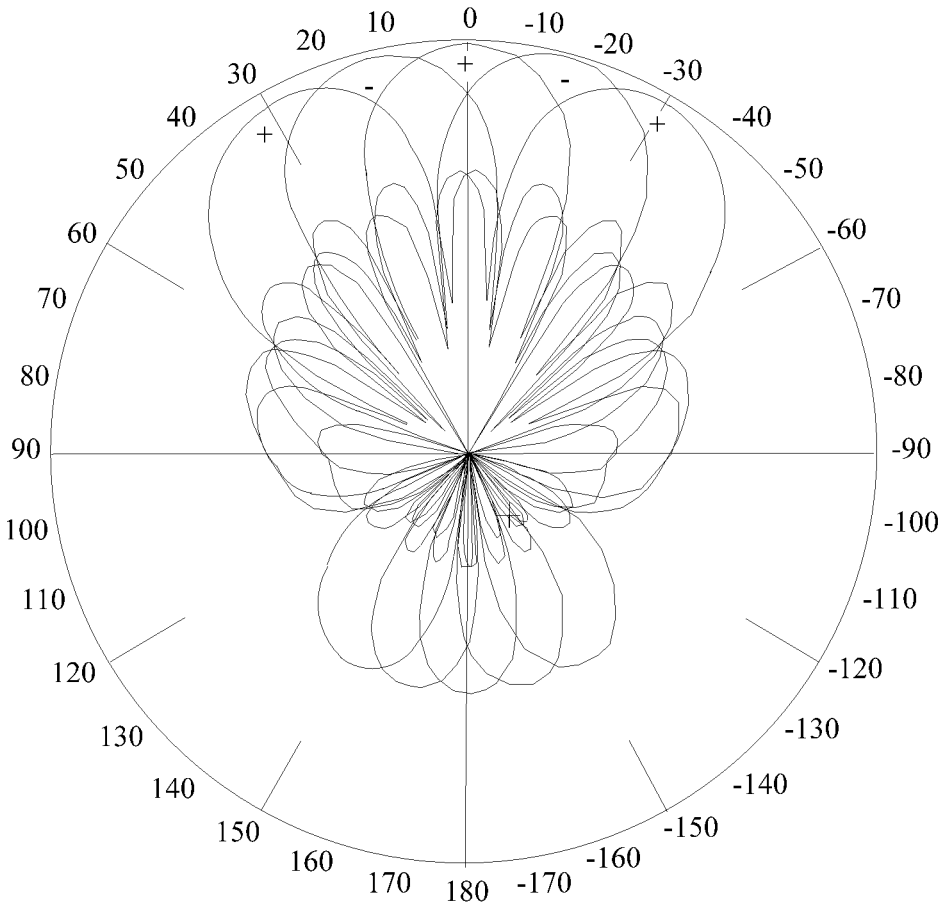
FIG. 7 is a schematic diagram of five beams that are formed by an interleaved polarized multi-beam antenna according to an embodiment of the present invention.

By using the first Butler matrix and the second Butler matrix in this embodiment, the antenna array transmits beams shown in FIG. 7. It can be seen that, by means of the interleaved polarized multi-beam antenna in this embodiment, complexity, a loss, and costs of implementation of a Butler matrix can be effectively reduced, and interference between adjacent multiplexed beams can be effectively decreased.

That the interleaved polarized multi-beam antenna forms five beams in this embodiment is used as an example for description, rather than a limitation. That is, a quantity of beams that may be specifically formed by the interleaved polarized multi-beam antenna is not limited in this embodiment, provided that the first target beam and the second target beam are arranged alternately, and any two adjacent beams have different directions and polarizations.

A person skilled in the art can clearly understand that, in the several embodiments provided in this application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present invention.

What is claimed is:

1. An interleaved polarized multi-beam antenna, comprising:

at least one dual-polarized antenna element comprising a +45-degree-polarized first antenna element and a −45-degree-polarized second antenna element; and a first Butler matrix and a second Butler matrix, wherein the first Butler matrix is connected to the first antenna element so that the first antenna element transmits a first target beam, the first target beam is generated by the first Butler matrix according to a first input signal received by at least one first beam port, and each first target beam points to a different direction; and the second Butler matrix is connected to the second antenna element so that the second antenna element transmits a second target beam, the second target beam is generated by the second Butler matrix according to a second input signal received by at least one second beam port, and each second target beam points to a different direction, wherein one second target beam is arranged between any two adjacent first target beams; wherein the interleaved polarized multi-beam antenna comprises six dual-polarized antenna elements, first target beams are generated by the first Butler matrix according to first input signals received by three first beam ports, and second target beams are generated by the second Butler matrix according to second input signals received by two second beam ports; and the first Butler matrix comprises:

a first group of bridges, a second group of bridges, and a first group of power splitters, wherein the first group of bridges are connected to the three first beam ports to receive three first input signals, and the first group of bridges generate four signals in total according to the three first input signals and output the four signals; and the second group of bridges are connected to the first group of bridges to receive the four signals output by the first group of bridges, the second group of bridges generate four signals in total according to the four signals output by the first group of bridges and output the four signals, the second group of bridges output two signals generated by the second group of bridges to the first group of power splitters connected to the second group of bridges, and the second group of bridges output the other two signals generated by the second group of bridges to first antenna elements of two of the dual-polarized antenna elements; and the first group of power splitters are configured to: split each of the two signals input from the second group of bridges into two signals, and output the formed four signals to first antenna elements of four of the dual-polarized antenna elements, so that six first antenna elements transmit the first target beams.

2. The interleaved polarized multi-beam antenna according to claim 1, wherein the first group of bridges comprise a first bridge and a second bridge, the first bridge is a three-decibel 90-degree bridge, and the second bridge is a three-decibel 180-degree bridge;

the second group of bridges comprise a third bridge and a fourth bridge, and the third bridge and the fourth bridge are both a three-decibel 180-degree bridge; and the first group of power splitters comprise a first power splitter and a second power splitter, and a ratio of divided power output by the first power splitter and the second power splitter is 3:7.

3. The interleaved polarized multi-beam antenna according to claim 1, wherein the second Butler matrix comprises:

a third group of bridges, a fourth group of bridges, a first group of phase shifters, a second group of power splitters, and a second group of phase shifters, wherein the third group of bridges are connected to the two second beam ports to receive two second input signals, the third group of bridges generate four signals in total according to the two second input signals and output the four signals, the third group of bridges output two signals generated by the third group of bridges to the first group of phase shifters connected to the third group of bridges, and the third group of bridges output the other two signals generated by the third group of bridges to the fourth group of bridges connected to the third group of bridges;

the fourth group of bridges are connected to the first group of phase shifters, the fourth group of bridges receive two signals that are output by the first group of phase shifters after performing phase shift and the two signals output by the third group of bridges to generate four signals and output the four signals, the fourth group of bridges output two signals output by the fourth group of bridges to second antenna elements of two of the dual-polarized antenna elements, and the fourth group of bridges output the other two signals output by the fourth group of bridges to the second group of power splitters connected to the fourth group of bridges; and the second group of power splitters are configured to split each of the two signals that are input from the fourth group of bridges into two signals to form four signals in total and output the four signals, the second group of power splitters output two signals output by the second group of power splitters to the second group of phase shifters connected to the second group of power splitters, the second group of phase shifters output two phase-shifted signals to second antenna elements of two of the dual-polarized antenna elements, and the second group of power splitters output the other two signals output by the second group of power splitters to second antenna elements of two of the dual-polarized antenna elements, so that six second antenna elements transmit the second target beams.

4. The interleaved polarized multi-beam antenna according to claim 3, wherein the third group of bridges comprise a fifth bridge and a sixth bridge, and the fifth bridge and the sixth bridge are both a three-decibel 90-degree bridge;

the fourth group of bridges comprise a seventh bridge and an eighth bridge, and the seventh bridge and the eighth bridge are both a three-decibel 90-degree bridge;

the first group of phase shifters comprise a first phase shifter and a second phase shifter, and phases shifted by the first phase shifter and the second phase shifter are both −45 degrees;

the second group of power splitters comprise a third power splitter and a fourth power splitter, and a ratio of divided power output by the third power splitter and the fourth power splitter is 3:7; and the second group of phase shifters comprise a third phase shifter and a fourth phase shifter, and phases shifted by the third phase shifter and the fourth phase shifter are both −180 degrees.

* * * * *